US005768676A

United States Patent [19]

Hokari et al.

[11] Patent Number: 5,768,676

[45] Date of Patent: Jun. 16, 1998

[54] METHOD OF SETTING A POSITION OF A MOVABLE MEMBER, AND A POSITION SETTING JIG

[75] Inventors: Norio Hokari; Mikio Kobayashi; Shuji Iseki; Yukio Hayashi; Junichirou Sameshima; Ryoichi Tsuruoka, all of Ebina, Japan

[73] Assignee: Fuji Xerox Co., Ltd., Tokyo, Japan

[21] Appl. No.: 727,988

[22] Filed: Oct. 10, 1996

[30] Foreign Application Priority Data

Oct. 13, 1995 [JP] Japan ..... 7-265992
Jun. 7, 1996 [JP] Japan ..... 8-146235

[51] Int. Cl.[6] ..... G03G 21/00

[52] U.S. Cl. ..... 399/351; 15/256.51; 399/126; 399/316

[58] Field of Search ..... 399/126, 316, 399/350, 351, 308, 303, 343; 29/281.5, 281.6; 15/256.5, 256.51, 1.51

[56] References Cited

U.S. PATENT DOCUMENTS

| | | | |
|---|---|---|---|
| 3,927,936 | 12/1975 | Komori et al. | 399/126 |
| 4,803,752 | 2/1989 | Kasama | 15/256.51 |
| 5,225,879 | 7/1993 | Hayashida | 399/316 X |
| 5,517,294 | 5/1996 | Ogiri et al. | 399/351 |

FOREIGN PATENT DOCUMENTS

A-59-197071 11/1984 Japan .

A-61-267078 11/1986 Japan .

*Primary Examiner*—Arthur T. Grimley
*Assistant Examiner*—Sophia S. Chen
*Attorney, Agent, or Firm*—Oliff & Berridge,P.L.C.

[57] ABSTRACT

In order to set a position of a movable member in which a strip-like movable member which is disposed to be movable along a width direction perpendicular to a longitudinal direction of the member is disposed so that one edge of the movable member along the longitudinal direction facing a defined line; and the strip-like movable member is positioned with respect to a fixing member under a condition where the one edge is parallel to the defined line to maintain a uniform protruding amount from the defined line is maintained, the one edge of the movable member is made coincident with the defined line; the movable member is temporily fixed to the fixing member by interposing a position setting jig according to the protruding amount between the movable member and the fixing member; and after cancelling the temporarily fixing step to remove the position setting jig, directly fixing the movable member to the stationary member. Alternatively, a position setting jig according to the protruding amount is made coincident with the define line; and after abutting the one edge of the movable member against the position setting jig, the movable member is fixed to the fixing member. Further, position setting jigs for a movable member suitable for the above methods is provided.

12 Claims, 8 Drawing Sheets

METHOD OF SETTING A POSITION OF A MOVABLE MEMBER, AND A POSITION SETTING JIG

BACKGROUND OF THE INVENTION

1. Field of the Invention

The invention relates to a method of setting a position of a movable member suitably used in, for example, a case where one edge along the longitudinal direction of a narrow flat blade which is disposed so as to be movable in the width direction is required to be positioned with respect to another member with a uniform protruding amount, and also to a position setting jig which is suitably used when the method is executed.

2. Description of the Related Art

A so-called image forming apparatus such as a copying machine or a printer which utilizes electrophotography is generally provided with a mechanism in which unwanted toners adhering to the surface of a photosensitive drum or a transfer belt is removed by an elastic cleaning blade. In the case of a photosensitive drum, the mechanism is configured in such a manner that, in the downstream side of a transfer step, an edge elongating in a longitudinal direction of a blade made of an elastic material such as rubber is compressedly contacted with the surface of the photosensitive drum with an appropriate pressure, so as to scrape the residual toners. In the system for removing toners by the blade, if the bite amount of the edge of the blade with respect to the surface of the photosensitive drum is not kept uniform, unbalance is produced in the toner removing effect in the axial direction of the photosensitive drum, and the rotation of the photosensitive drum is adversely affected. In the case of a transfer belt, the belt is caused to meander.

To comply with this, techniques for making the bite amount of the edge of the blade proper and uniform have been proposed. For example, Unexamined Japanese Patent Publication (Kokai) No. SHO 59-197071 discloses that a blade is held by a holding member and then the front end which abuts against a drum is cut off. In another example, as disclosed in Unexamined Japanese Patent Publication (Kokai) No. SHO 61-267078, both end portions of a blade are supported so as to be movable forward and backward with respect to a photosensitive drum, and the moving amount of the edge is adjusted by an adjusting screw.

The former technique involves a drawback that high cutting accuracy is required. In the latter technique, the bite amount in the longitudinal direction can be adjusted but there is no means for strictly uniformarizing the bite amount. In addition, the structure is complicated and increases in the number of components and the cost are introduced.

SUMMARY OF THE INVENTION

It is an object of the invention to provide a method and a position setting jig capable of easily positioning with high accuracy and suppressing the number of components and the cost, when an edge of a movable member such as a blade is to be positioned with respect to a stationary member with a proper and uniform bite amount.

According to the invention, generally two methods of setting a position of a movable member are provided.

In one method according to the present invention of setting a position of a movable member in which a strip-like movable member which is disposed to be movable along a width direction perpendicular to a longitudinal direction of the member is disposed so that one edge of the movable member along the longitudinal direction facing a defined line; and the strip-like movable member is positioned with respect to a fixing member under a condition where the one edge is parallel to the defined line to maintain a uniform protruding amount from the defined line is maintained; the method comprises the steps of: making the one edge of the movable member coincident with the defined line; temporarily fixing the movable member to the fixing member by interposing a position setting jig according to the protruding amount between the movable member and the fixing member; and after cancelling the temporarily fixing step to remove the position setting jig, directly fixing the movable member to the stationary member.

In the method, the movable member is finally directly fixed to the stationary member, so that the one edge of the movable member protrudes from the defined line by an amount corresponding to the position setting jig. The position setting jig is defined in accordance with the protruding amount. Therefore, the protruding amount is properly set. Since only the position setting jig is used, increases in the number of components and the cost can be suppressed, and a proper protruding amount can be easily set with high accuracy.

In another method according to the present invention of setting a position of a movable member in which a strip-like movable member which is disposed to be movable along a width direction perpendicular to a longitudinal direction of the member is disposed so that one edge of the movable member along the longitudinal direction facing a defined line; and the strip-like movable member is positioned with respect to a fixing member under a condition where the one edge is parallel to the defined line to maintain a uniform protruding amount from the defined line is maintained; the method comprises the steps of: making a position setting jig according to the protruding amount coincident with the define line; and after abutting the one edge of the movable member against the position setting jig, fixing the movable member to the fixing member.

In the method, the position setting is completed only by causing the one edge of the movable member to directly abut against the position setting jig and then fixing the movable member to the stationary member. Consequently, the setting can be simplified.

Further, according to the invention, generally, two position setting jigs for a movable member are provided.

In one position setting jig used for setting a position of a movable member in which a strip-like movable member which is disposed to be movable along a width direction perpendicular to a longitudinal direction of the member is disposed so that one edge of the movable member along the longitudinal direction facing a defined line; and the strip-like movable member is positioned with respect to a fixing member under a condition where the one edge is parallel to the defined line to maintain a uniform protruding amount from the defined line is maintained; the position setting jig is formed as a plate having a uniform thickness corresponding to the protruding amount; the position setting jig is sandwiched between the fixing member and the movable member so that one surface of the jig abuts against the fixing member and the other surface abuts against the movable member; and the position setting jig is removably interposed between the members.

In the position setting jig, one face first abuts against the stationary member, and then the movable member abuts against the other face. The position setting jig is interposed between the members, and the one edge of the movable member is made coincident with the defined line of the stationary member. This condition is temporarily fixed. Next, the temporary fixing is canceled and the position setting jig is removed. Thereafter, the movable member is directly fixed to the stationary member. When the movable member is finally and directly fixed to the stationary member, the one edge of the movable member protrudes from the defined line by an amount corresponding to the thickness of the position setting jig. Since the thickness of the position setting jig is selected in accordance with the protruding amount, the protruding amount of the one edge is properly set. Accordingly, the position setting jig is suitably used for executing the former one of the above-described two methods. In addition, since only the thickness is defined, increases in the number of components and the cost can be suppressed, and a proper protruding amount can be easily set with high accuracy.

In another position setting jig used for setting a position of a movable member in which a strip-like movable member which is disposed to be movable along a width direction perpendicular to a longitudinal direction of the member is disposed so that one edge of the movable member along the longitudinal direction facing a defined line; and the strip-like movable member is positioned with respect to a fixing member under a condition where the one edge is parallel to the defined line to maintain a uniform protruding amount from the defined line is maintained, the position setting jig comprises: a reference surface which abuts against the defined line; and an abutting portion against which the one edge of the movable member is to abut, the abutting portion being disposed at a position spaced from the reference surface face in accordance with the protruding amount.

In the position setting jig, the reference face abuts against the defined line, and then the one edge of the movable member directly abuts against the abutting portion. Thereafter, the movable member is fixed to the stationary member, thereby completing the position setting. Therefore, the position setting jig is suitably used for executing the latter one of the above-described two methods. Since only the reference face and the abutting portion are defined, increases in the number of components and the cost can be suppressed, and a proper protruding amount can be easily set with high accuracy.

PREFERRED EMBODIMENTS OF THE INVENTION

A. First Embodiment

Figure 1:
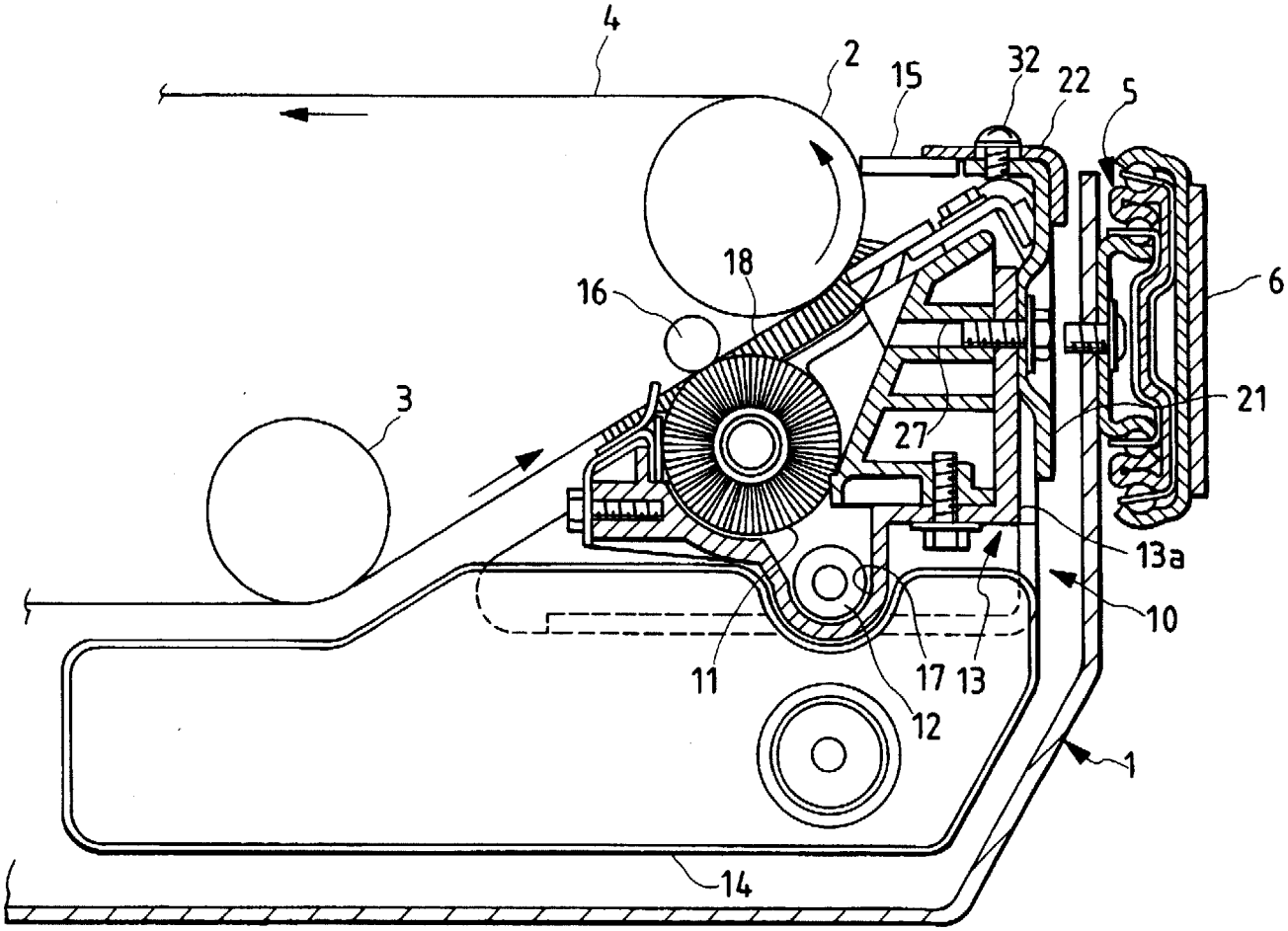
FIG. 1 is a side section view, in partial section, of a transfer device of a copying machine to which an embodiment of the invention is applied.

FIG. 1 shows a side face of a part (a right end portion) of a transfer device incorporated in a multicolor copying machine to which a method and a position setting jig of a first embodiment are applied. The transfer device is first described. In the following description, a back-and-forth direction and a right-and-left direction are defined as the back-and-front direction and the right-and-left direction of the sheet of FIG. 1, respectively.

Figure 5:
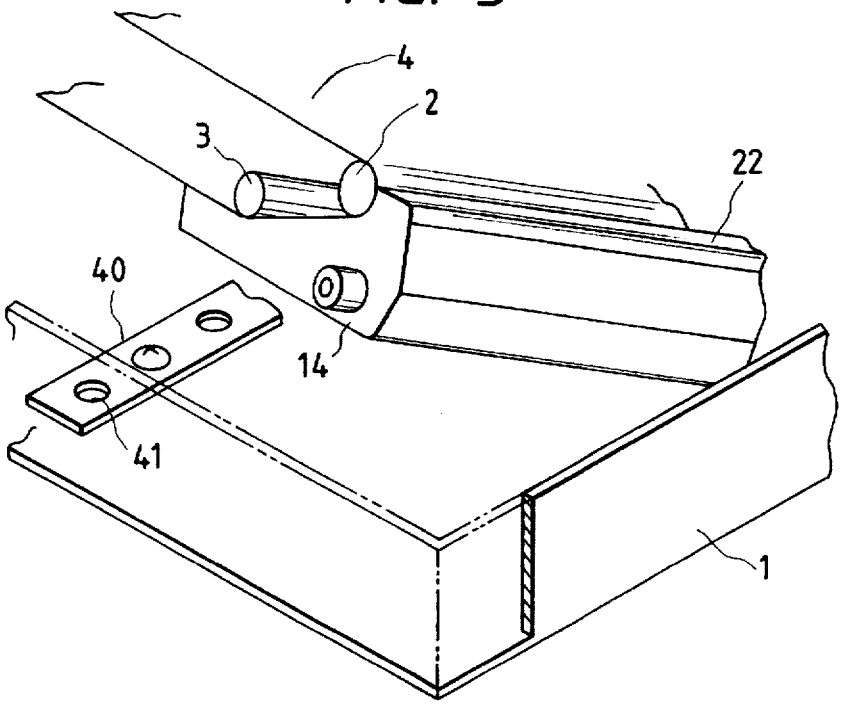
FIG. 5 is a schematic perspective view showing a condition where the transfer device shown in FIG. 1 is opened.

The reference numeral 1 of FIG. 1 designates a frame of the transfer device. A driving roller 2 and a plurality of driven rollers 3 (only one of which is shown in FIG. 1) are disposed in the frame 1 at predetermined positions so that their axial directions are aligned in the back-and-forth direction. A transfer belt (movable member, transfer material carrying member) 4 for transporting a sheet which is not shown is wound around the rollers 2 and 3. The transfer belt 4 is made of a dielectric film, and driven in a direction indicated by the arrows by the rotation of the driving roller 2, so as to transport a sheet in the direction. The frame 1 is supported by sliders 5 of a two-stage structure which are provided in front of and behind the frame 1 (only the behind one is shown in FIG. 1), in such a manner that the frame can slide in the back-and forth direction along a rail 6 in the copying machine. The transfer device, together with the frame 1, can be pushed into and pulled out from the copying machine. In the transfer device, an end portion on the innermost side is hinged on the frame 1. In a condition where the transfer device and the frame 1 are pulled out so as to be positioned outside the copying machine, as shown in FIG. 5, the upper side can be tilted up. When the copying machine is tilted up, the bottom portion of the frame 1 is opened.

Above a flat traveling portion which is the upper side of the transfer belt 4, image forming units for a plurality of colors (usually, four colors of black, yellow, magenta, and cyan) which are not shown are disposed at regular pitches along the traveling direction. Each image forming unit generally comprises a photosensitive drum, a charge corotron, latent image writing unit, and a developer. A transfer corotron is disposed under the photosensitive drum with the transfer belt 4 between them. A discharge corotron is disposed in the downstream side of the transfer corotron. These transfer and discharge corotrons are not shown, but they constitute part of the transfer device.

A cleaning unit 10 for removing toners adhering to the surface of the transfer belt 4 is accommodated in a right end portion of the transfer device shown in FIG. 1. The cleaning unit 10 comprises a cylindrical cleaning brush 11, a toner recovering auger 12, a housing (fixing member) 13 for supporting the brush and the auger, a toner recovering box 14 disposed under the housing 13, and a cleaning blade 15.

The brush 11 is arranged in parallel to the driving roller 2 so that the outer circumferential portion of the brush is compressedly contacted with the surface of the traveling portion of the transfer belt 4 ranging from the illustrated driven roller 3 to the driving roller 2. The brush 11 is rotated in the same direction as that of the driving roller 2. By the rotation, adhered toners are scraped off and removed. A pressurized roller 16 is disposed inside the transfer belt 4 so as to cooperate with the brush 11 to sandwich the transfer belt 4 between them. The inner face of the transfer belt 4 which is pressed by the brush 11 abuts against the pressurized roller 16, thereby allowing the brush 11 to be compressedly contacted with a pressure which is uniform in the axial direction of the transfer belt 4.

A toner storing groove 17 which elongates in the back-and-forth direction is formed in the bottom portion of the housing 13. The toner recovering auger 12 is accommodated in the toner storing groove 17. The toners scraped off by the brush 11 are stored in the toner storing groove 17. The toners are then transported to the rear portion of the toner storing groove 17 by the toner recovering auger 12 which is rotated around a shaft, and then dropped into the toner recovering box 14. A shutter 18 is provided in each of the front and rear portions of the housing 13 so that the gap between the housing 13 and the transfer belt 4 is closed, thereby preventing the toners from scattering to the outside of the housing 13.

Figure 2:
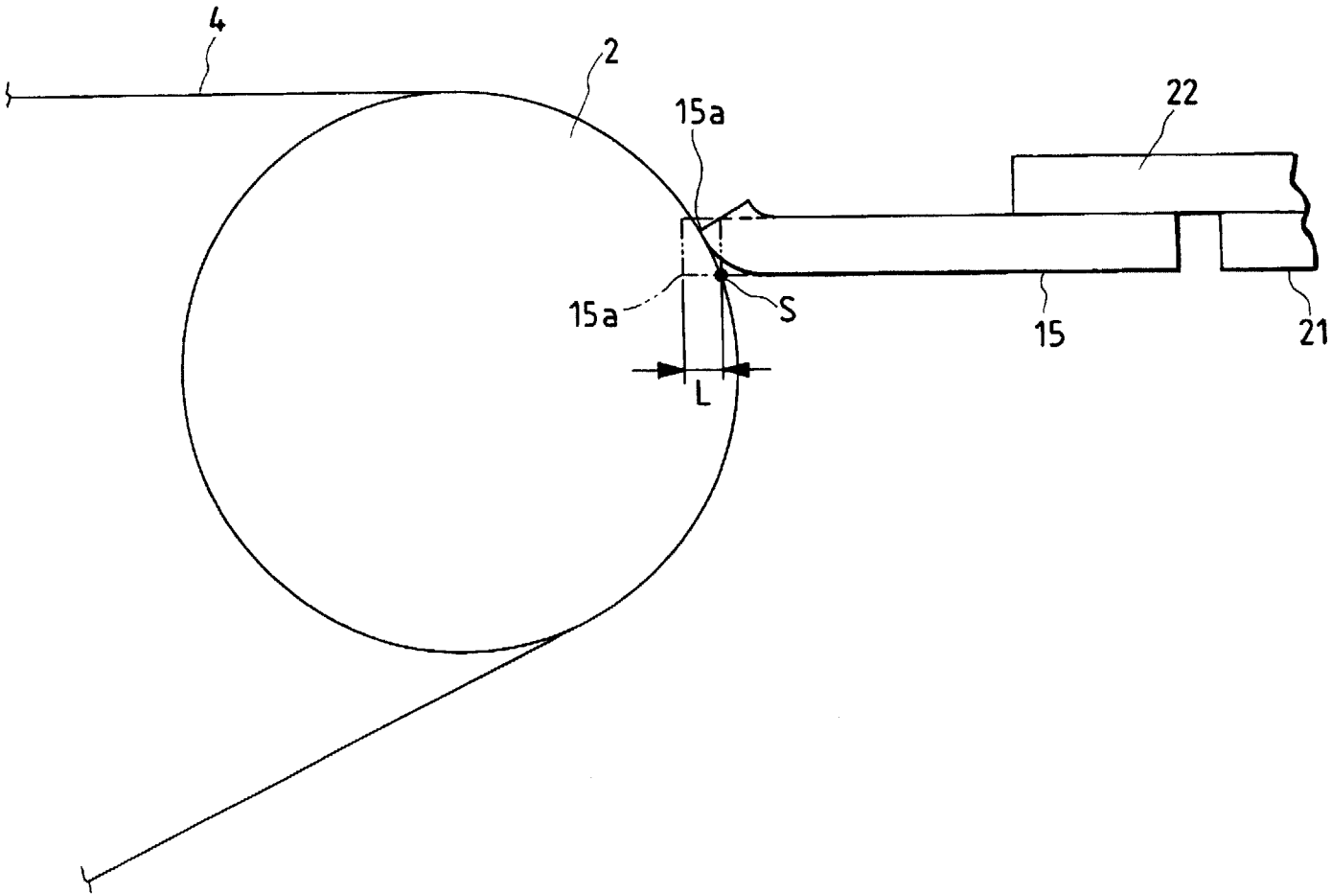
FIG. 2 is a partial enlarged view of FIG. 1.

A first bracket 21 is fixed to the right end face of the housing 13 with bolts. A second bracket 22 is fixed to the first bracket 21 with screws. The cleaning blade 15 is fixed to the second bracket 22. The cleaning blade (elastic member: hereinafter simply referred to as blade) 15 has a strip shape having a length which can sufficiently cover the total width of the transfer belt 4, and is made of an elastic material such as rubber, or a resin. The lower edge (one edge) 15*a* shown in FIG. 2 of the front end portion which is one end portion along the longitudinal direction is compressedly contacted with the surface of the transfer belt 4 which is wound around the driving roller 2, with a predetermined bite amount. As shown in FIG. 2, a proper value of the bite amount L in this case is set so as to be 1.0 mm±0.3 mm. In an actual condition, the blade 15 is compressedly contacted with the surface of the transfer belt 4 in an elastic manner with being slightly rolled up.

Figure 3:
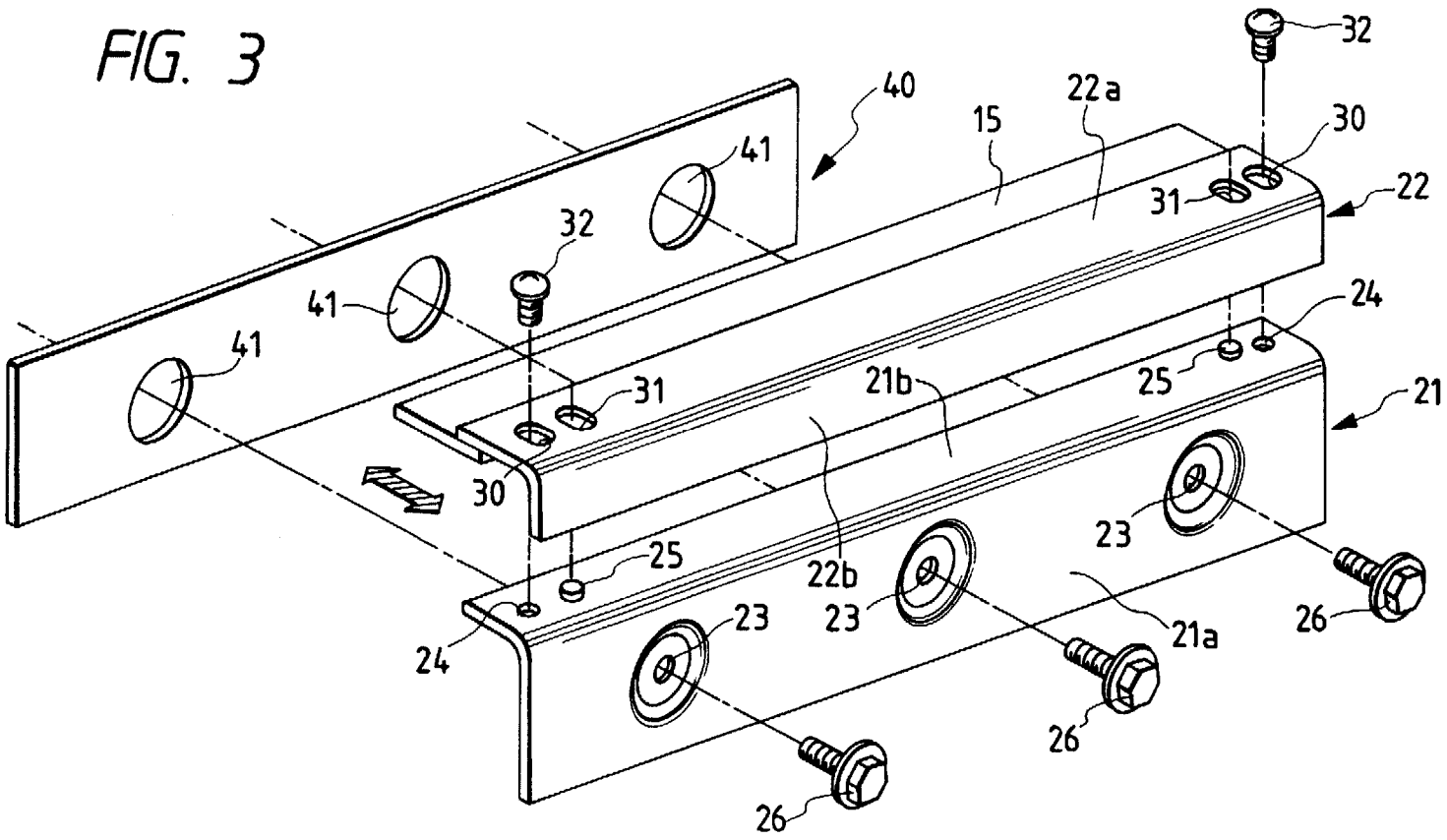
FIG. 3 is a perspective view of a bracket and a spacer.

The brackets 21 and 22 are plate members having an L-like section shape and respectively including long-width portions 21*a* and 22*a* and short-width portions 21*b* and 22*b*. As shown in FIG. 3, a plurality of (three in this case) bolt passing holes 23 are formed in the long-width portion 21*a* of the first bracket 21 at regular pitches in the longitudinal direction. A tapped hole 24 is formed in each of the end portions of the short-width portion 21*b*. A projection 25 is formed at positions inside each tapped hole. The long-width portion 21*a* of the first bracket 21 is disposed on an attaching face 13*a* which is the right end face of the housing 13, and bolts 26 which are passed through the bolt passing holes 23 are screwed into screw holes 27 formed in the housing 13, thereby fixing the first bracket 21 to the housing 13. In this fixing condition, the longitudinal direction of the first bracket 21 is coincident with the back-and-forth direction. The attaching face 13*a* of the housing 13 is parallel to the axial direction of the driving roller 2, and hence also the first bracket 21 which is fixed to the attaching face 13*a* is parallel to the axial direction of the driving roller 2.

Screw passing holes 30 and positioning holes 31 are formed in the end portions of the long-width portion 22*a* of the second bracket 22 in the longitudinal direction (back-and-forth direction) thereof, respectively, corresponding to the tapped holes 24 and the projections 25 of the first bracket 21. The screw passing holes 30 and the positioning holes 31 are long holes elongating in the width direction (right-and-left direction) of the long-width portion 22*a*. The second bracket 22 is fixed to the first bracket 21 in the following manner. The short-width portion 22*b* is positioned along the outer face of the long-width portion 21*a* of the first bracket 21, and the projections 25 are fitted into the positioning holes 31 in the end portions, so that the positioning in the longitudinal direction is performed. At the same time, the long-width portion 22*a* is placed over the short-width portion 21*b* of the first bracket 21, and screws 32 which are passed through the screw passing holes 30 are then screwed into the tapped holes 24.

The edge 15*a* of the blade 15 is compressedly contacted with the surface of the transfer belt 4 wound around the driving roller 2, with a predetermined bite amount. The base end portion which is not compressedly contacted with the belt surface is fixed to the lower face of the long-width portion 22*a* of the second bracket 22 by means of an adhesive or the like. That is, the blade 15 is integral with the second bracket 22, and can be relatively moved in the right-and-left direction with respect to the first bracket 21 by the length of the screw holes 30 of the second bracket 22. In the embodiment, the blade 15 and the brackets 21 and 22 constitute the movable member.

Method of the first embodiment will be described.

The proper bite amount L shown in FIG. 2 of the edge 15*a* of the blade 15 to the transfer belt 4 is attained in a condition where the edge 15*a* is parallel to the axial direction of the driving roller 2. The embodiment is a method by which the proper bite amount L is obtained uniformly in the longitudinal direction. The method will be described below. The adjustment is performed in a condition where the transfer device, together with the frame 1, is pulled out from the copying machine and tilted up as shown in FIG. 5.

Figure 4A:
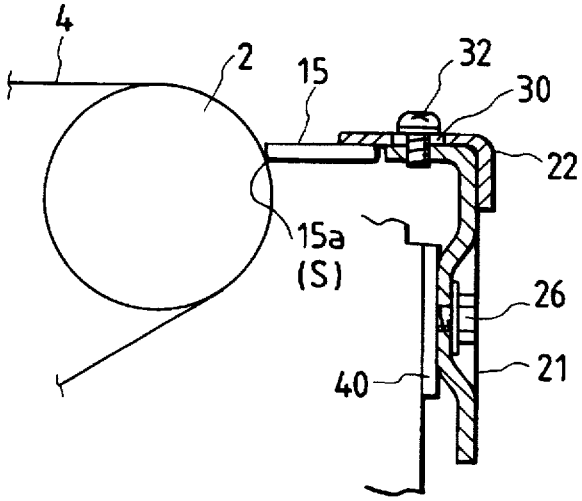
FIG. 4A is a side section view showing a temporary fixing condition where the spacer is interposed.

First, the screws 32 are loosened so that the first bracket 21 and the second bracket 22 can relatively slide. Next, as shown in FIG. 4A, the first bracket 21 is fixed to the attaching face 13*a* of the housing 13 by the bolts 26 while sandwiching a spacer (position setting jig) 40. As shown in FIG. 3, the spacer 40 is a metal plate having a rectangular shape and a uniform thickness. The length of the spacer is equal to that of the brackets 21 and 22. Similarly to the first bracket 21, the spacer 40 has bolt passing holes 41. The thickness is uniform and set so as to be 1.0 mm in accordance with the bite amount. The spacer 40 is made coincident with the inner face of the long-width portion 21*a* of the first bracket 21. The bolts 26 are passed through the aligned bolt passing holes 23 and 41. The bolts 26 are then screwed into the screw holes 27 of the housing 13, thereby fixing the spacer and the bracket to the housing 13.

Next, the blade 15, together with the second bracket 22, is slid toward the transfer belt 4, so that the edge 15*a* of the front end of the blade 15 which faces the transfer belt 4 abuts against the surface of the transfer belt 4 which is wound around the driving roller 2. It is important that the edge 15*a* is linearly contacted with the surface of the transfer belt 4 without causing the blade 15 to be bent and deformed, and without forming a gap between the blade and the transfer belt 4. As shown in FIG. 2, the portion where the edge 15*a* is linearly contacted with the surface of the transfer belt 4 functioning as a defined line S in this case.

Figure 4B:
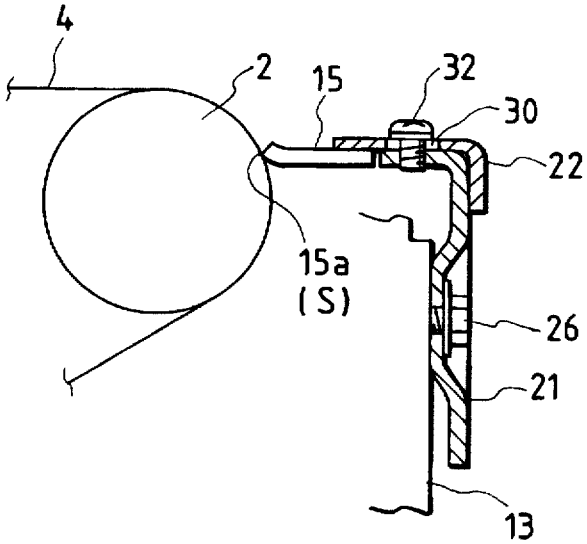
FIG. 4B is a side section view showing a final fixing condition.

Next, the condition where the edge 15*a* of the blade 15 is linearly contacted with the transfer belt 4 is maintained by tightening the loosened screws 32 so as to fix the second bracket 22 to the first bracket 21. Thus, the relative positional relationship between the blade 15 and the second bracket 22 which function as the movable member, and the first bracket 21 is defined. Next, the bolts 26 are removed so that the temporary fixing of the first bracket 21 to the housing 13 is canceled and the spacer 40 is removed. As shown in FIG. 4B, the first bracket 21 is directly fixed to the housing 13 without interposing the spacer 40 between them.

When the spacer 40 is not attached, or before and after the use thereof, the spacer 40 is screwed to the upper face of the bottom portion of the frame 1 by using the bolt passing holes 41, as shown in FIG. 5, for the purpose of convenience in the use of the next adjustment. The positional adjustment of the blade 15 is performed while the transfer device, together with the frame 1, is pulled out from the copying machine and tilted up the 40 can be easily attached to and detached from the upper face of the bottom portion of the frame 1, and conveniently used.

According to the above-described method, when the spacer 40 is removed and the first bracket 21 is finally fixed to the housing 13, the whole, i.e., the first and second brackets 21 and 22 and the blade 15 are moved toward the transfer belt 4 by the amount corresponding to the thickness of the spacer 40. Thus, the edge 15*a* of the blade 15 bites the surface of the transfer belt 4 by the amount corresponding to the thickness of the spacer 40.

In the stage where the second bracket 22 is fixed to the first bracket 21, the relative positional relationship between the brackets 21 and 22 is defined. In the defined condition, the edge 15*a* of the blade 15 abuts against the surface of the transfer belt 4 in parallel to the driving roller 2 without forming any gap between them and without being bent. When the spacer 40 having the uniform thickness is removed and the first bracket 21 is directly fixed to the housing 13, therefore, the bite amount L of 1.0 mm which is uniform in the longitudinal direction is set for the edge 15*a* of the blade 15 with respect to the surface of the transfer belt 4.

According to this method, if care is taken to cause the edge 15*a* of the blade 15 to precisely abut against the surface of the transfer belt 4 in a temporary fixing condition of the first bracket 21, the bite amount of the edge 15*a* can be easily set with high accuracy. Since only the spacer 40 of a simple plate-like shape is used, increases in the number of components and the cost can be suppressed. The spacer 40 is not attached in the assembled condition, and hence any additional space will not be required. This contributes to the miniaturization of the apparatus.

Measurement example of the first embodiment is will be described.

The position of the blade 15 was actually set by the above-described method, and variations of the bite amount of the edge 15*a* in the longitudinal direction were measured with varying the manner of tightening the bolts 26 when the first bracket 21 was finally fixed to the housing 13. The measured results are shown in the Table 1 below. In Table 1, IN, CENTER, and OUT indicate an end portion on the front side, a center portion, and an end portion on the rear side (innermost side) in the longitudinal direction of the blade 15, respectively. The bite amount was measured at these positions. The bolts 26 were tightened in the following three manners: (1) uniform: three bolts are gradually tightened with uniform tightening strengths; (2) IN→OUT: three bolts are perfectly tightened one by one in the sequence starting from the one at IN; and (3) OUT→IN: three bolts are perfectly tightened one by one in the sequence starting from the one at OUT.

TABLE 1

| | Method of tightening bolts | Bite amount (mm) IN | CENTER | OUT |
|---|---|---|---|---|
| (1) | UNIFORM | 0.9 | 0.9 | 1.0 |
| (2) | IN → OUT | 1.0 | 1.0 | 1.0 |
| (3) | OUT → IN | 1.0 | 1.0 | 1.0 |

Figure 6:
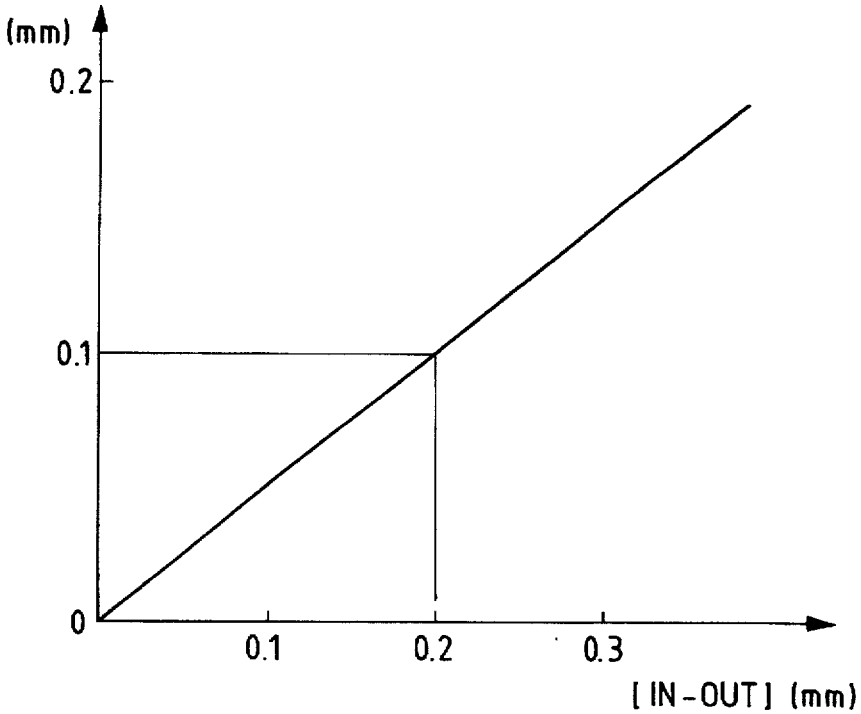
FIG. 6 is a graph showing a degree of meandering of a transfer belt caused by a difference in a bite amount between the IN side and the OUT side of a blade.

It is apparent that, as a difference in the bite amount between the IN side and the OUT side of the blade 15 becomes larger, the degree of meandering of the transfer belt 4 is further increased. This relationship is shown in FIG. 6. If the allowable limit of the meandering is 0.1 mm, for example, the degree attained in the method can be within the allowable range.

Now, modification of the first embodiment will be described.

Figure 7:
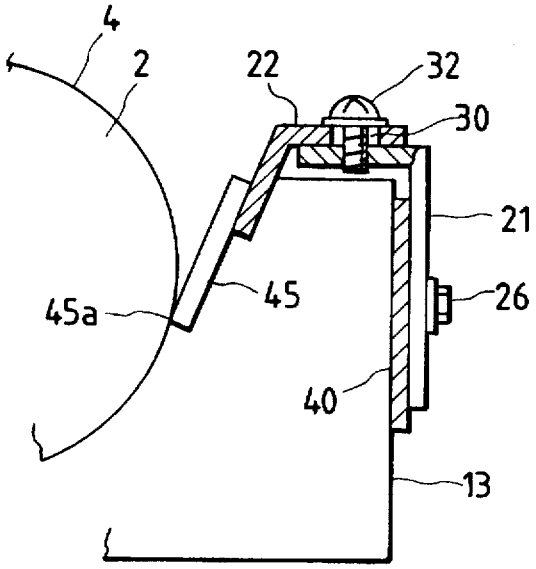
FIG. 7 is a side view illustrating a modification of the first embodiment.

The blade 15 is directed in the forward direction according to the driving direction of the transfer belt 4 which is wound around the driving roller 2, so that the lower face of the blade opposes the transfer belt 4. The method can be applied also to a so-called doctor blade which is directed in the opposite direction. FIG. 7 shows an example of such an application. A doctor blade 45 in the-drawing is directed in the direction opposite to the driving direction of the transfer belt 4. An edge 45*a* of an end portion on the upper side is compressedly contacted with the surface of the transfer belt 4 so as to scrape off toners. Also as for the edge 45*a* of the doctor blade 45, a proper bite amount with respect to the surface of the transfer belt 4 is set. When the positioning is performed with using a spacer 40 in a similar manner as the above-described, it is possible to obtain the set bite amount in a uniform condition in the longitudinal direction.

B. Second Embodiment

Figure 8:
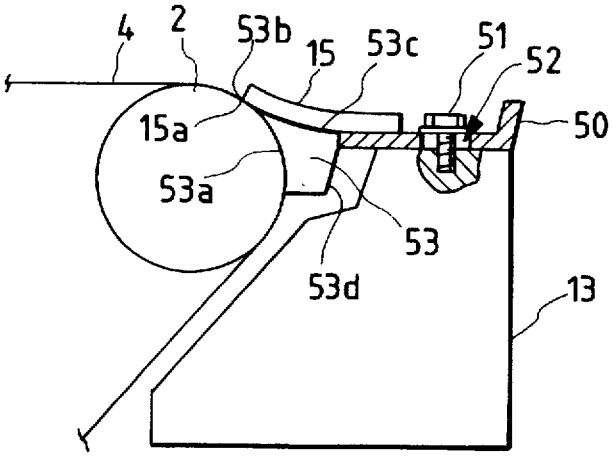
FIG. 8 is a side view illustrating a second embodiment.

The reference numerals 2, 4, 13, and 15 in FIG. 8 respectively designate a driving roller, a transfer belt, a housing, and a blade which are the same as those described above. In the embodiment, the blade 15 is fixed to the upper face of a bracket 50 which is fixed to the upper face of the housing 13. The bracket 50 is a plate member having an L-like section shape, and fixed to the housing 13 with bolts 51. Bolt passing holes 52 of the bracket 50 are long holes elongating in the right-and-left direction. The blade 15 can slide integrally with the bracket 50 in the right-and-left direction by an amount corresponding to the length of the bolt passing holes 52. The housing 13 is fixed to a frame (not shown) of a copying machine.

Method of the second embodiment will be described.

When the blade 15 is to be positioned in the embodiment, a spacer (position setting jig) 53 is used. The spacer 53 has a length corresponding to the width of the transfer belt 4, and has a curved face (reference face) 53*a* which is to be mated with the surface of the transfer belt 4 wound around the driving roller 2. An edge (abutting portion) 53*b* which is an upper edge of the curved face 53*a*, an upper face 53*c*, and an abutting face 53*d* which is the right end face are formed in parallel to the longitudinal direction of the spacer 53. In a set condition where the upper face 53*c* is directed upward and the curved face 53*a* is mated with the surface of the transfer belt 4 wound around the driving roller 2, the spacer 53 is disposed so that the edge 53*b* is at a position corresponding to the bite amount of the edge 15*a* of the blade 15 from the defined line S.

When the blade 15 is to be set by using the spacer 53, the bolts 51 are first loosened so that the bracket 50 car slide in the right-and-left direction with respect to the housing 13. Then, the spacer 53 is inserted from the front side between the bracket 50 and the transfer belt 4, thereby attaining the above-mentioned set condition. Next, the whole length of the front edge of the bracket 50 is caused to abut against the abutting face 53*d* of the spacer 53. The size relationships among the blade 15, the bracket 50, and the spacer 53 are set in such a manner that, in a condition where the front edge of the bracket 50 abuts against the abutting face 53*d* as described above, the edge 15*a* of the blade 15 coincidently abuts against the edge 53*b* of the spacer 53.

Next, the condition where the edge 15*a* of the blade 15 is coincident with the edge 53*b* of the spacer 53 is held by fixing the bracket 50 to the housing 13 by tightening the bolts 51 which have been loosened. Thereafter, the housing 13 is once taken out of the frame and the spacer 53 is removed. Then, the housing 13 is again fixed to the frame.

According to the method of the second embodiment, when the spacer 53 is caused to abut against the bracket 50 which is integral with the blade 15, the bite amount of the blade 15 with respect to the surface of the transfer belt 4 is properly set. This condition is held by fixing the bracket 50 to the housing 13. In the same manner as the first embodiment therefore, the proper bite amount of the edge 15*a* of the blade 15 can be easily set with high accuracy, while enabling increases in the number of components and the cost to be suppressed.

C. Third Embodiment

Next, a third embodiment in which the invention is applied to the positioning of a transfer baffle (transfer pressing plate) in the above-described transfer device will be described.

Figure 9:
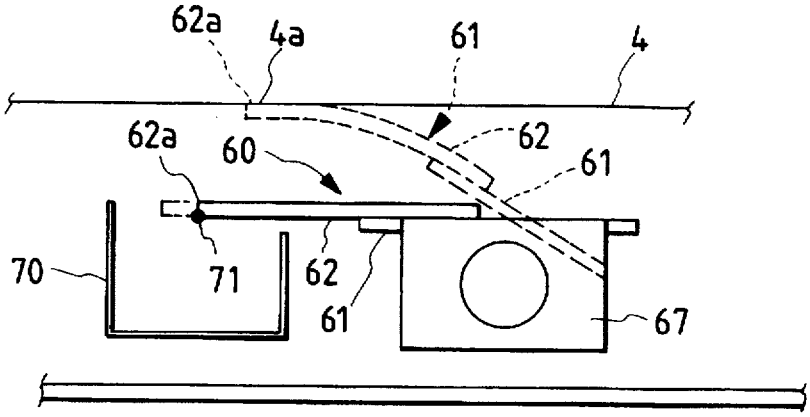
FIG. 9 is a side view of a transfer baffle to which a third embodiment is applied.
Figure 10:
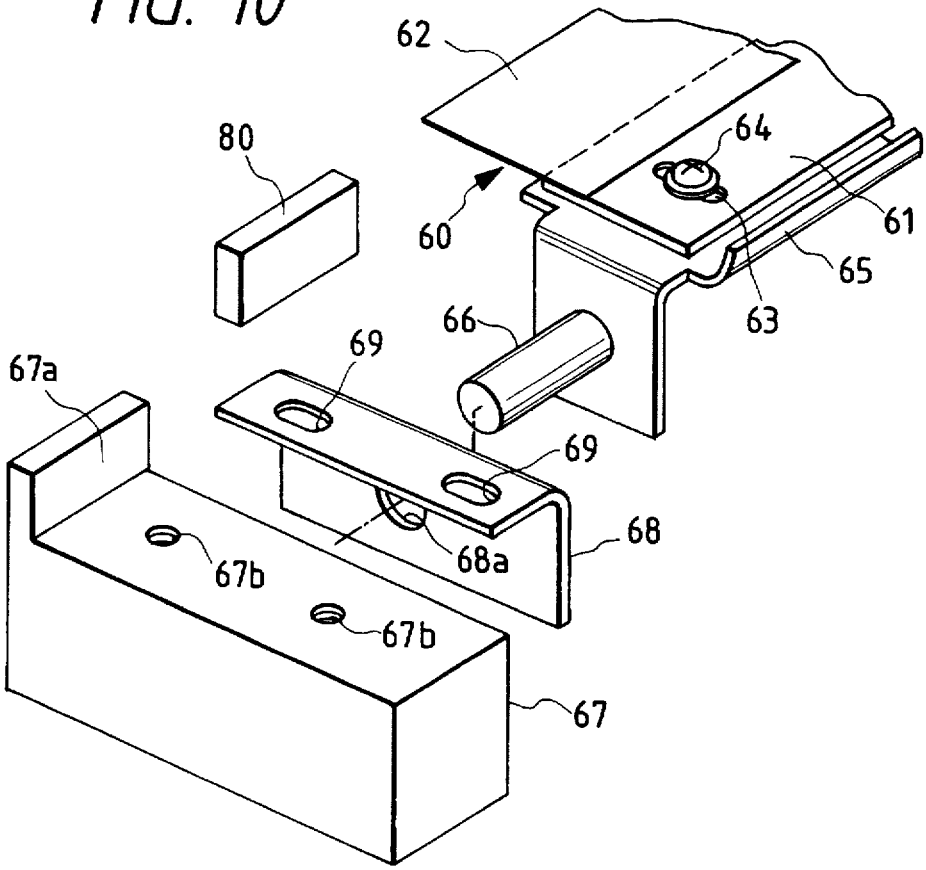
FIG. 10 is a perspective view showing an attachment structure of the transfer baffle.

The reference numerals 60 and 70 in FIG. 9 designate the transfer baffle and a transfer corotron, respectively. The transfer baffle 60 appropriately presses the lower face of the transfer belt 4, whereby a transfer portion 4*a* along the width direction of the transfer belt 4 is linearly formed and the distance between the transfer portion 4*a* and a wire 71 of the transfer corotron 70 is defined to be constant so that good transfer is realized. In the transfer baffle 60, as shown in FIG. 10, a pressing plate 62 made of an elastic material such as rubber or a resin is integrally fixed to a supporting plate 61 by means of an adhesive or the like. The pressing plate 62 is directed toward the transfer corotron 70 which is positioned in the left, and the transfer baffle 60 is fixed to a rotatable plate 65 by screws 64 which are passed through screw holes 63 formed in both end portions of the supporting plate 61. The screw holes 63 are long holes elongating in the width direction (right-and-left direction). When the screws 64 are loosened, the transfer baffle 60 can slide with respect to the rotatable plate 65.

The rotatable plate 65 is rotatably supported by a supporting block (stationary member) 67 which is fixed to a frame of a copying machine which is not shown, via a rotation shaft 66 which protrudes from each end. A bracket 68 is fixed to the inside of the supporting block 67 with screws. Screw passing holes 69 are long holes elongating in the right-and-left direction. Screws (not shown) which are passed through the holes are screwed into tapped holes 67*b*, so that the bracket 68 is fixed slidably in the right-and-left direction with respect to the supporting block 67. The rotation shaft 66 is fitted into a bearing hole 68*a* formed in the bracket 68 thereby allowing the rotatable plate 65 to rotate about the shaft elongating in the right-and-left direction. A slit (not shown) is formed in the inside of the supporting block 67 so that the rotation shaft 66 is inserted and the rotatable plate 65 and the transfer baffle 60 together with the bracket 68 can slide in the right-and-left direction. At the left end of the supporting block 67, a stopper wall 67*a* which protrudes upward is formed.

In operation, the transfer baffle 60 is upward rotated as shown in FIG. 9 so that an upper edge (one edge) 62*a* of the front end of the pressing plate 62 elastically presses the lower face of the transfer belt 4. The position where the edge 62*a* abuts against the transfer belt 4, i.e., the positional relationship between the transfer portion 4*a* and the wire 71 of the transfer corotron 70 is defined so as to realize good transfer. The setting method for this purpose is performed by in a condition where the transfer baffle 60 is parallel to the transfer belt 4, causing the front end of the pressing plate 62 to protrude from the wire 71 of the transfer corotron 70 by length corresponding to the transfer portion 4*a*. The setting method will be described below.

First, a spacer (position setting jig) 80 shown in FIG. 10 which has a thickness equal to the protruding amount of the pressing plate 62 from the wire 71 is caused to abut against the inner face of the stopper wall 67*a* of the supporting block 67. Next, the bracket 68 is slid toward the stopper wall 67*a* so as to abut against the spacer 80, and the bracket 68 is temporarily fixed to the supporting block 67. That is, the spacer 80 is interposed between the bracket 68 and the stopper wall 67*a*, and the bracket 68 is then temporarily fixed to the supporting block 67.

Next, the screw 64 is loosened and the transfer baffle 60 is slid in the right-and-left direction. Thus, the front end of the pressing plate 62 is caused to abut against the wire 71 of the transfer corotron 70 without bending and deforming the pressing plate 62 and without forming any gap between the plate and the wire 71. This condition is held by fixing the supporting plate 61 to the rotatable plate 65 by tightening the screw 64. In this way, the relative positional relationship between the transfer baffle 60 and the rotatable plate 65 which function as the movable member, and the bracket 68 is defined Next, the fixing screws for the bracket 68 are loosened, the bracket 68 is slightly moved backward to the right, and the spacer 80 is removed. Then, the bracket 68 is caused to abut against the stopper wall 67*a* without interposing the spacer 80 between them, and the bracket 68 is directly fixed to the supporting block 67.

According to the method of the third embodiment, when the spacer 80 is finally removed and the bracket 68 is directly fixed to the supporting block 67, the transfer baffle 60 is moved together with the rotatable plate 65 toward the transfer corotron 70 by an amount corresponding to the thickness of the spacer 80. Accordingly, the edge 62*a* of the pressing plate 62 protrudes from the wire 71 by a length corresponding to the transfer portion 4*a*, and the protruding amount L is uniform in the longitudinal direction. In the transfer operation, therefore, the edge 62*a* of the pressing plate 62 of the transfer baffle 60 presses the transfer belt 4 in a proper condition.

Modification of the third embodiment will be described.

Figure 11:
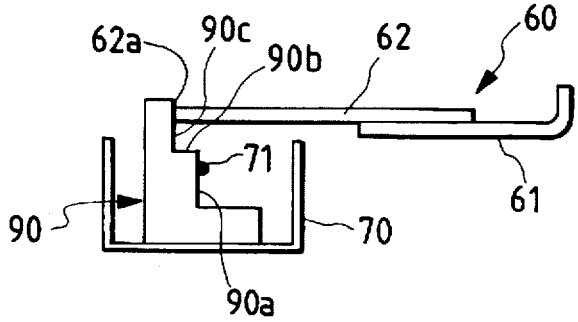
FIG. 11 is a side view illustrating a modification of the third embodiment.

FIG. 11 shows a modification of the third embodiment. In the modification, the transfer baffle 60 is positioned by using a spacer (position setting jig) 90 instead of the spacer 80. The spacer 90 is temporarily disposed in the corotron 70 and is a plate member having an L-like section shape. The spacer 90 comprises a reference face 90*a* which is caused to abut against the left side of the wire 71, and a setting face (abutting portion) 90*c* for ensuring the aforementioned protruding amount L from the reference face 90*a* to the wire 71 via a step 90*b*. The width of the step 90*b* is set so as to be equal to the protruding amount L, and both the faces 90*a* and 90*c* are formed in parallel to each other.

When the transfer baffle 60 is to be set by using the spacer 90, the spacer 90 is disposed in the corotron 70, and the reference face 90*a* is first caused to abut against the left side of the wire 71. Next, the front end including the edge 62*a* of the pressing plate 62 of the transfer baffle 60 which can slide is caused to abut against the-setting face 90*c*. This condition is held by fixing the bracket 68 to the supporting block 67. Thereafter, the spacer 90 is removed from the corotron 70. According to this method, similarly to the above-described method, in the transfer operation, the edge 62*a* of the pressing plate 62 of the transfer baffle 60 presses the transfer belt 4 in the proper transfer portion 4*a*. Unlike the above-described method, the position setting is completed when the pressing plate 62 of the transfer baffle 60 is caused to abut against the setting face 90*c* of the spacer 90. Thus, the position setting can be easily performed in a shorter time.

The embodiments described above are the setting methods in which the cleaning blade and the transfer baffle of the transfer device incorporated in the copying machine are positioned. The invention is not restricted to them. The invention can be applied to any case where a strip-like movable member which is movable in the width direction perpendicular to the longitudinal direction is disposed in such a manner that one edge along the longitudinal direction faces a defined line of a stationary member, the one edge is set in parallel to the defined line, and the positioning is performed in the condition where a uniform protruding amount from the defined line is held.

As seen from the above description, the invention car attain the following effects.

A position setting jig according to the protruding amount from the defined line is used, and hence the proper protruding amount of the movable member can be easily set with high accuracy while suppressing increases the number of components and the cost; In addition, since the position setting is completed only by fixing the movable member to a stationary member after the one edge of the movable member is caused to directly abut against the position setting jig, the setting operation can be simplified.

What is claimed is:

1. A method of setting a position of a strip-like movable member which is disposed to be movable along a width direction perpendicular to a longitudinal direction of said strip-like movable member so that one edge of said strip-like movable member along said longitudinal direction faces a defined line; and said strip-like movable member is positioned with respect to a fixing member under a condition where said one edge is parallel to said defined line to maintain a uniform protruding amount from said defined line; said method comprising the steps of:

making said one edge of said strip-like movable member coincident with said defined line;

temporarily fixing said strip-like movable member to said fixing member and interposing a position setting jig according to said protruding amount between said fixing member and a stationary member; and after canceling said temporarily fixing step to remove said position setting jig, directly fixing said fixing member to said stationary member.

2. A method of setting a position of a strip-like movable member according to claim 1, wherein an abutting portion of said strip-like movable member which abuts against said defined line is made of an elastic member.

3. A method of setting a position of a strip-like movable member according to claim 2, wherein said abutting portion of said strip-like movable member which is to abut against said defined line is caused to abut against said defined line in a condition where an end portion made of said elastic member is not deformed.

4. A method of setting a position of a strip-like movable member according to claim 1, wherein said strip-like movable member is a cleaning blade for cleaning residual toners on a moving body.

5. A method of setting a position of a strip-like movable member according to claim 1, wherein said strip-like movable member is a transfer pressing plate for pressing a transfer material against a toner image carrying body via a transfer material carrying member.

6. A method of setting a position of a strip-like movable member which is disposed to be movable along a width direction perpendicular to a longitudinal direction of said strip-like movable member so that one edge of said strip-like movable member along said longitudinal direction faces a defined line; and said strip-like movable member is a transfer pressing plate for pressing a transfer material against a toner image carrying body via a transfer material carrying member and is positioned with respect to a fixing member under a condition where said one edge is parallel to said defined line to maintain a uniform protruding amount from said defined line, said method comprising the steps of:

making a position setting jig according to said protruding amount coincident with said define line; and after abutting said one edge of said strip-like movable member against said position setting jig, fixing said strip-like movable member to said fixing member.

7. A method of setting a position of a strip-like movable member according to claim 6, wherein an abutting portion of said strip-like movable member which abuts against said defined line is made of an elastic member.

8. A method of setting a position of a strip-like movable member according to claim 7, wherein said abutting portion of said strip-like movable member which is to abut against said defined line is caused to abut against said defined line in a condition where an end portion made of said elastic member is not deformed.

9. A position setting jig used for setting a position of a strip-like movable member which is disposed to be movable along a width direction perpendicular to a longitudinal direction of said strip-like member so that one edge of said strip-like movable member along said longitudinal direction faces a defined line; and said strip-like movable member is positioned with respect to a fixing member under a condition where said one edge is parallel to said defined line to maintain a uniform protruding amount from said defined line; wherein said position setting jig is formed as a plate having a uniform thickness corresponding to said protruding amount; said position setting jig is sandwiched between said fixing member and a stationary member so that one surface of said jig abuts against said fixing member and the other surface abuts against said stationary member; and said position setting jig is removably interposed between said fixing member and said stationary member.

10. A position setting jig for a strip-like movable member according to claim 9, wherein, when not in use, said position setting jig is disposed in the vicinity of a positioning portion of said strip-like movable member.

11. A position setting jig used for setting a position of a strip-like movable member disposed to be movable along a width direction perpendicular to a longitudinal direction of said strip-like movable member so that one edge of said strip-like movable member along said longitudinal direction faces a defined line; and said strip-like movable member is positioned with respect to a fixing member under a condition where said one edge is parallel to said defined line to maintain a uniform protruding amount from said defined line, said position setting jig comprising:

a reference face which abuts against said defined line; and an abutting portion against which said one edge of said strip-like movable member is to abut, said abutting portion being disposed at a position spaced from said reference face in accordance with said protruding amount.

12. A position setting jig for a strip-like movable member according to claim 11, wherein, when not in use, said position setting jig is disposed in the vicinity of a positioning portion of said strip-like movable member.

* * * * *